United States Patent [19]

Wenger et al.

[11] 4,306,750

[45] Dec. 22, 1981

[54] MUSICIAN'S CHAIR

[75] Inventors: Jerry A. Wenger, Owatonna; Darrel E. Newell, Lakeville, both of Minn.

[73] Assignee: Wenger Corporation, Owatonna, Minn.

[21] Appl. No.: 83,840

[22] Filed: Oct. 11, 1979

[51] Int. Cl.[3] ..... A47C 7/02

[52] U.S. Cl. ..... 297/458; 297/459

[58] Field of Search ..... 297/458, 459, 460, 284, 297/445

[56] References Cited

U.S. PATENT DOCUMENTS

| | | | |
|---|---|---|---|
| 483,265 | 9/1892 | Schindler | 297/313 |
| 623,985 | 5/1899 | Coffman | 297/458 |
| 633,087 | 9/1899 | Johnson | 297/313 |
| 1,516,811 | 11/1924 | Edwards | 297/313 X |
| 1,716,871 | 6/1929 | Weldon | 297/460 |
| 1,917,264 | 7/1933 | Kellogg | 297/460 |
| 1,938,879 | 12/1933 | Waggoner et al. | 297/459 |
| 2,646,839 | 7/1953 | Hillman | 297/313 |
| 2,647,560 | 8/1953 | Huebruer | 297/460 X |
| 2,845,998 | 8/1958 | Estabrook et al. | 297/459 |
| 3,220,771 | 11/1965 | Doss | 297/459 |
| 3,527,498 | 9/1970 | Werner | 297/458 |
| 4,076,308 | 2/1978 | Slabon et al. | 297/313 |

FOREIGN PATENT DOCUMENTS

| | | | |
|---|---|---|---|
| 355330 | 6/1922 | Fed. Rep. of Germany | 297/313 |
| 2657843 | 5/1978 | Fed. Rep. of Germany | 297/284 |

OTHER PUBLICATIONS

Bulletin 616 Entitled "Basic Design Measurements for Setting," Agricultural Experiment Station, University at Arkansas, Fayetteville, Arkansas. Oct., 1959.

*Primary Examiner*—Francis K. Zugel

*Attorney, Agent, or Firm*—Dorsey, Windhorst, Hannaford, Whitney & Halladay

[57] ABSTRACT

A chair specifically engineered for performing musicians is disclosed. Extensive research and design has produced a vocal or instrumental musician's chair which permits proper diaphragmatic breathing and on which a musician can sit comfortably for long periods of practice or performance. This result is achieved by contouring the seat both for correct performing posture and for comfort. The orientation of the back-rest of the chair to the seat also enhances the posture of the performer and this, in conjunction with the positioning of the body relative to the floor, contributes to the ability of the performer to breathe properly while seated comfortably, thus reducing fatigue and greatly enhancing the tonal quality of the performance.

15 Claims, 31 Drawing Figures

MUSICIAN'S CHAIR

BACKGROUND OF THE INVENTION

Good posture seating is a well-defined state of the art which has been in the public domain since at least as early as the middle 1940's. A number of studies have been done and inventive activity directed to the structural concept of seating and comfort. Consequently, comfortable home products exist for dining, writing, game playing or just relaxing and many office products exist which allow workers to work long hours without fatigue. Aeronautical and automotive seats have been developed so that operators can comfortably operate their vehicles for extended periods of time. Spectator seating at sporting events and cultural events, such as musical performances, has also benefited from prior studies and designs so that those audiences can remain comfortably seated throughout the performances.

The performing musician, however, has not received the benefit of such studies and designs because the performing musician seating requirements are a contradiction to good general posture seating due to the basic physiological requirements of the breathing apparatus necessary for a seated musical performance of the vocalist or wind instrumentalist. Consequently, operatic singers and choral groups stand to perform and observation of any school band or orchestral performance will reveal many of the musicians perched on the front edge of their folding chairs.

SUMMARY OF THE INVENTION

The disclosed invention is a musician's chair specifically engineered and designed for the performing vocalist or instrumental musician. The contour, width and length of the seat of the chair, the contour and orientation of the backrest and the height of the seat from the floor are all elements which are integrated to create a physiological environment suitable to the comfort and breathing of a performing musician. The design is also advantageous for the musician who plays a stringed instrument who must also maintain a proper posture while holding the instrument and exerting a significant amount of arm movement.

The invention is achieved by designing the general plane of the seat upon which the thighs rest in conjunction with the seat height above the floor and the angle of the backrest to the seat to open the thigh to abdomen angle while the back of the performer is held erect. With this design the organs and upper body weight supported by the spine are in balance to relax and muscles and permit the body to hold a proper position for long periods of time without discomfort caused when muscle tension occurs, yet it allows the diaphragm to be pushed forward and down for proper breathing to assure the uniform high tonal quality of performance. In addition, the combination of the backrest of the chair and the general pelvic plane of the seat forces the body to sit erect while the pelvis is rotated forward so that the body assumes a natural sacro-lumbar curve without restricting diaphragmatic breathing. Finally, within these limits the seat is contoured for proper support to relieve posterior discomfort caused by sensitive pressure points in the buttocks and thighs.

It is therefore an object of the invention to permit proper diaphragmatic breathing of the performing musician.

It is a similar object of the invention to permit the diaphragm of the performing musician to function freely when the musician is seated on a chair constructed according to the invention.

It is another object of the invention to maintain a natural sacro-lumbar curve of the spine of the performing musician when seated on a chair constructed in accordance with the invention.

It is another object of the invention to relieve muscle tension which would occur if the body weight carried by the spinal column were out of balance.

It is another object of the invention to provide comfortable seating for long hours of performance without fatigue or discomfort.

These and other objects and advantages of the present invention will become apparent from a consideration of the following description in connection with the drawing.

DESCRIPTION OF THE DRAWINGS

FIG. 8, comprising

FIG. 9, comprising

FIG. 10, comprising

FIG. 11, comprising

DESCRIPTION OF THE PREFERRED EMBODIMENT

In order to appreciate the physical problems that can occur during a seated musical performance, especially for the vocalist or wind instrumentalist, it should first be understood that the standing posture is the only natural body attitude conducive to a good musical performance where diaphragmatic breathing is required. Opera singers are a good example of the physiological demands endured in a vocal performance where quality musical sound must be projected to every seat in the auditorium without the assistance of electronic amplification.

In order for a vocalist or instrumentalist to breathe properly the lungs must be filled completely and quickly. To do this, the throat must be relaxed and fully opened and the lungs must fill from the bottom. To accomplish this the diaphragm should be pushed forward and down. It is only in this position that there is enough room for the lungs to expand fully—they should fill out sideways as well as downwards. To inhale properly the diaphragm movement should be made first so that the lower part of the lungs fill first and the upper part of the lungs last. This must all happen in one continuous movement and the body and trunk should be upright and not slouched in any way.

Figure 1:
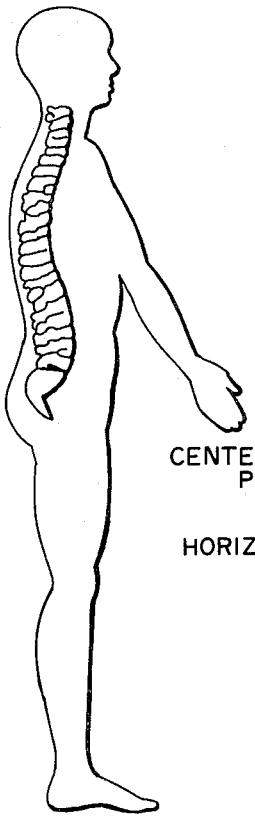
FIG. 1 is a diagrammatic representation of a human being in the normal standing posture showing the shape of the spinal column that forms what is called a "natural" or "relaxed" sacro-lumbar (Lordosis) curve which occurs naturally in the standing posture.

In the normal standing posture, the spinal column takes a shape that forms what is called a "natural" or "relaxed" sacro-lumbar curve shown in FIG. 1. When this happens the organs and upper body weight supported by the spine are in balance. This tends to relax the muscles and permits the body to hold this position for long periods of time without the discomfort caused when muscle tension occurs. The standing posture, therefore, does two things for the performing musician: (1) it permits the diaphragm to function freely and (2) it releases the muscle tension which occurs when body weight carried by the spinal column is out of balance.

The natural sacro-lumbar curve can only occur in the seated posture when the body is forced to sit erect. If a performer sits on a horizontal surface without a backrest or leans back on a conventional chair with a backrest, the pelvis, which is generally perpendicular to the seat, tilts backward and Kyphosis of the lower spine occurs, which usually causes muscle fatigue after only an hour of sitting. Therefore, many music instructors insist that students sit upright while playing regardless of the body posture suggested by the chair in which they are sitting. In order for the spinal column to assume a natural sacro-lumbar curve when the body is seated a contoured seat designed to rotate the pelvis forward is required.

Figure 2:
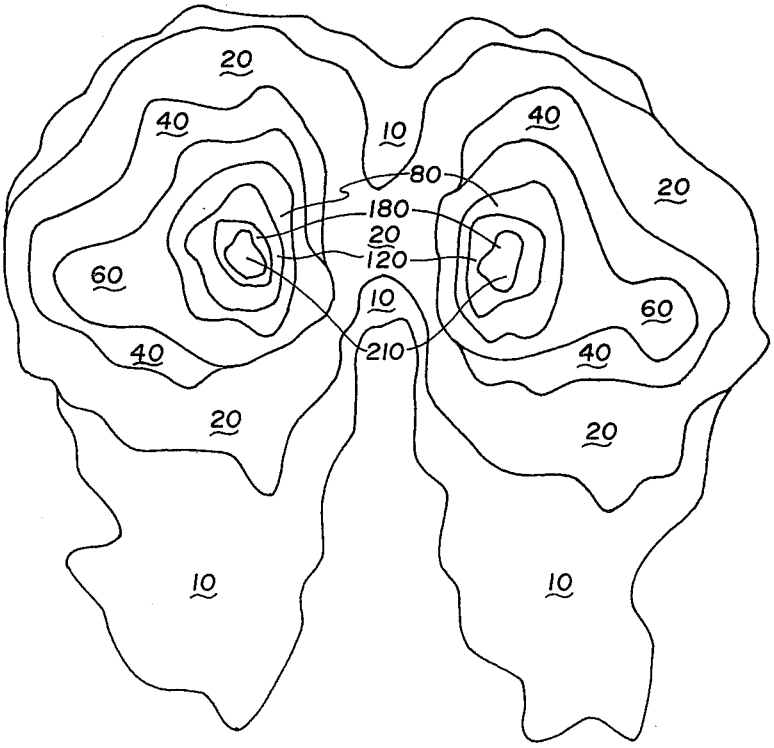
FIG. 2 is a diagram of the pressures created by the buttocks and thighs of a subject sitting on a hard, flat surface.

Most musicians are required to perform in the seated posture for extended periods of time. Sitting for long periods creates another source of discomfort. If the buttocks and thighs are not properly supported pressures are built up in certain sensitive areas that can result in severe pain. These pressure points occur as shown in FIG. 2 and cause extreme discomfort if the seat contour is not designed to fit the shape of the sitter's backside.

Most chairs manufactured today are designed for the home or office. They do not meet the needs of the seated performing musician. Consequently, the typical instrumentalist will be sitting in an upright posture on the front edge of a chair seat that is tilted to the rear. The back support is at such a reclining angle that the musician's back is normally six inches to twelve inches in front of it. This gives the performer about the same postural support and comfort that he would get while sitting on the top of a low stepladder and, in fact, the top of a stepladder would provide more useable sitting surface than that available at the front edge of most chairs.

Figure 3:
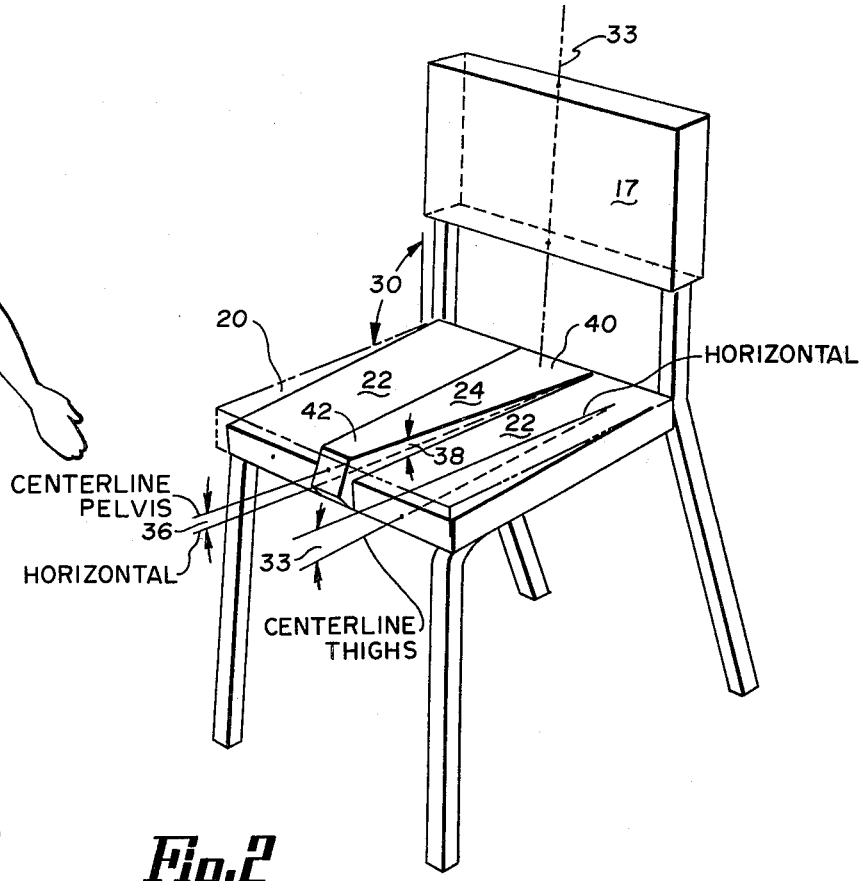
FIG. 3 diagrammatically represents the invention showing the general plane of the seat, the general plane of the seat for supporting the pelvis of the performer, the general plane of the seat for supporting the thighs of the performer, and the orientation of the backrest to the planes of the seat.

The chair 12 of the instant invention is designed to meet the basic body support requirements of the performing musician. As discussed above, diaphragmatic breathing must be achieved in an open, free and unrestricted manner while the pelvis must be rotated forward and the body held erect to relieve muscle discomfort. And the contour 13 of the seat 15 must be such that posterior discomfort is relieved. To achieve these objectives a major emphasis is placed on the seat 15 design and the relationship between the seat 15 to the backrest 17 and to the floor. FIG. 3 is a diagrammatic representation of the various general planes 20, 22, 24 of the seat 15 developed to open the diaphragm while providing comfort. As shown in FIG. 3 and also in FIG. 6, the general plane of the seat 20 is normally horizontal relative to the floor. This, however, is only reflected in the seating surface 21 around the edges of the seat 15 upon which the performer does not sit. In order to free the diaphragm for good breath control the portion 22 of the seat 15 that supports the thighs must be formed so that the thighs are slanted forward with knees pointed toward the floor. This frees the stomach muscles to "work" the diaphragm which, in turn, controls the pressure needed to sing or play a musical instrument. Therefore, the general plane of the thigh area 22 of the seat 15 is preferably sloped downwardly or slightly upwardly to open the angle between the torso and thighs of the seated musician.

The height of the seat 15 above the floor also must be sufficient to maintain the thighs slanted forward with both feet flat on the floor. This is not only important for diaphragmatic breathing. It is also necessary to help balance the instrument and support the upper arms which are sometimes extended. Often skillful arm movement is necessary in order to create a quality musical sound.

Figure 6:
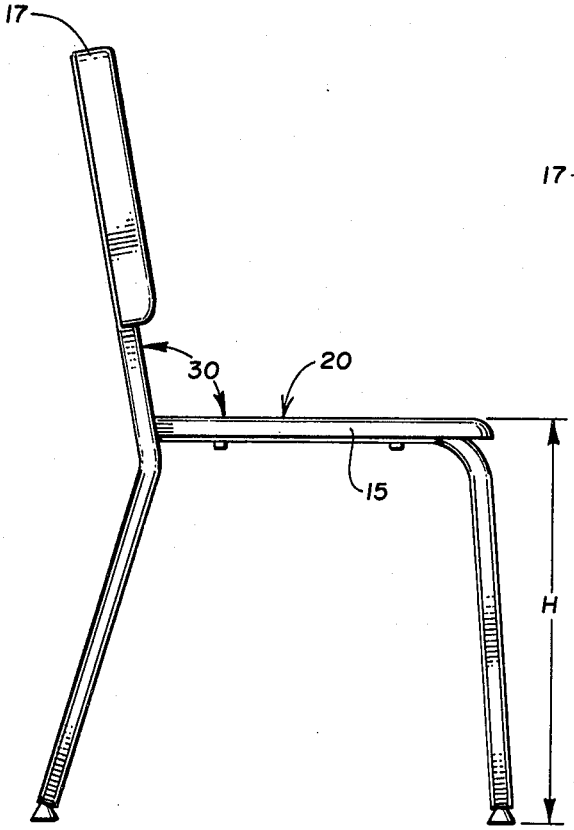
FIG. 6 is a side view of the chair shown in FIG. 4.
Figure 7:
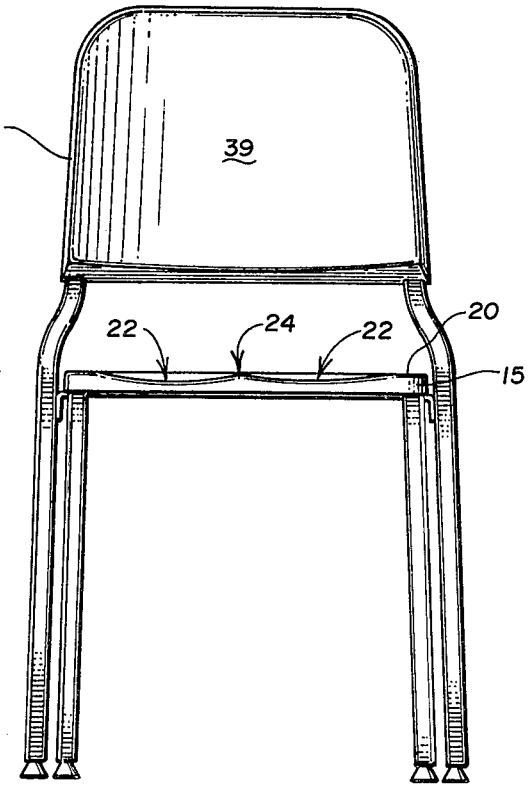
FIG. 7 is a front view of the chair shown in FIG. 4.
Figure 9A:
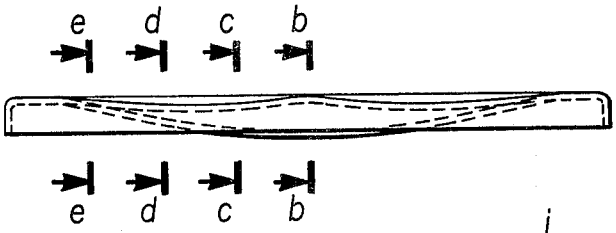
FIGS. 9*a* through 9*e*, shows, in FIG. 9*a*, a front elevational view of the seat and, in FIGS. 9*b* through 9*e*, wafer sections in elevation taken along the lines b—b, c—c, d—d, and e—e, respectively, of FIG. 9*a*.
Figure 8A:
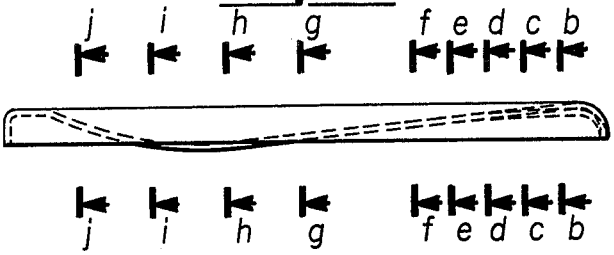
FIGS. 8*a* through 8*j*, shows, in FIG. 8*a*, a right side elevational view of the formed seat and, in FIGS. 8*b* through 8*i*, wafer sections in elevation taken along the lines b—b, c—c, d—d, e—e, f—f, g—g, h—h, i—i, and j—j, respectively, of FIG. 8*a*.
Figure 8B:
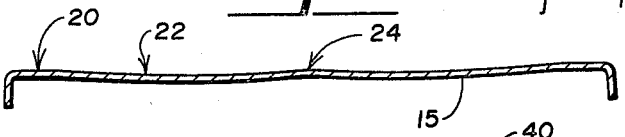
Figure 9B:
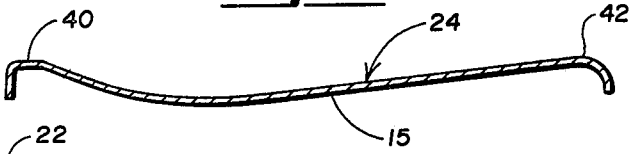
Figure 8C:
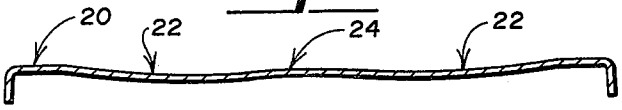
Figure 9C:
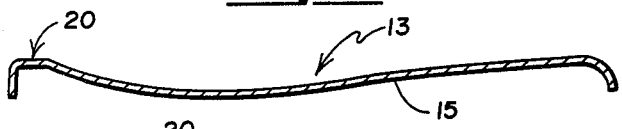
Figure 8D:
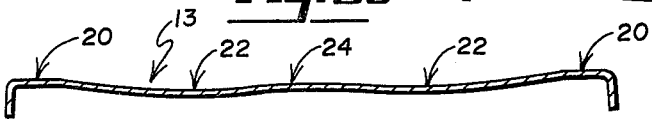
Figure 9D:
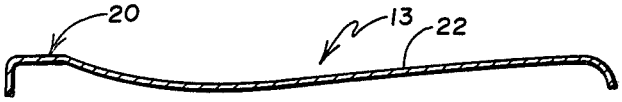
Figure 8E:
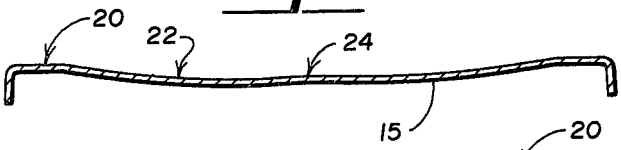
Figure 9E:
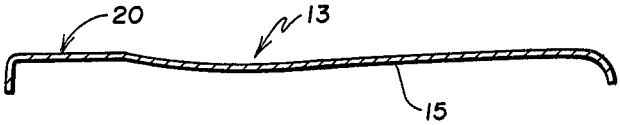
Figure 8F:
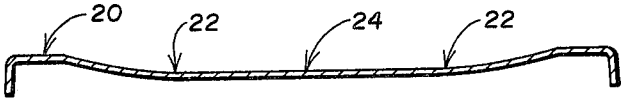
Figure 8G:
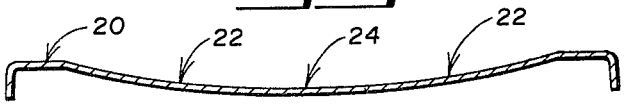
Figure 8H:
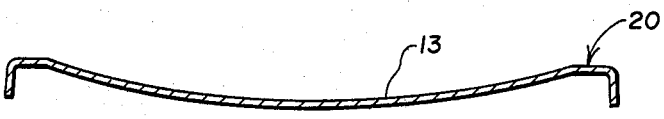
Figure 8I:
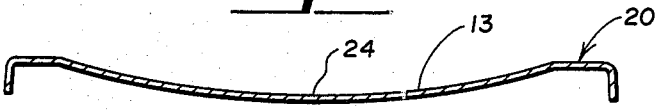
Figure 8J:
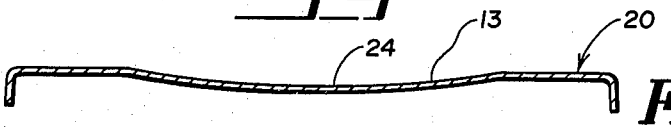
Figure 10A:
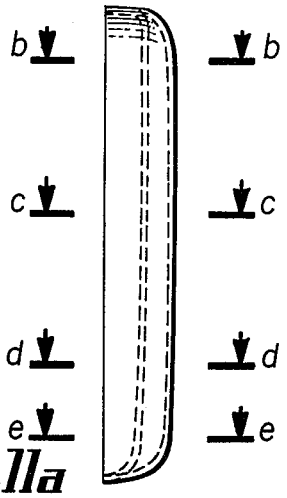
FIGS. 10*a* through 10*e*, shows, in FIG. 10*a*, a right side elevational view of the formed backrest of the invention and, in FIGS. 10*b* through 10*e*, wafer sections in plan taken along the lines b—b, c—c, d—d, and e—e, respectively, of FIG. 10*a*.
Figure 11A:
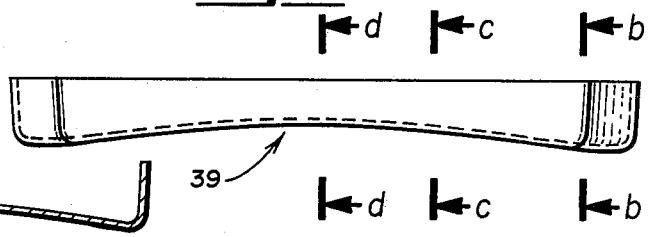
FIGS. 11*a* through 11*d*, shows, in FIG. 11*a*, a plan view of the formed backrest of the invention and, in FIGS. 11*b* through 11*d*, wafer sections in elevation taken along the lines b—b, c—c, and d—d, respectively, of FIG. 11*a*.
Figure 10B:
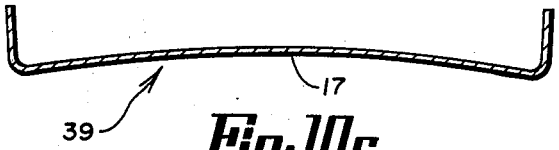
Figure 10C:
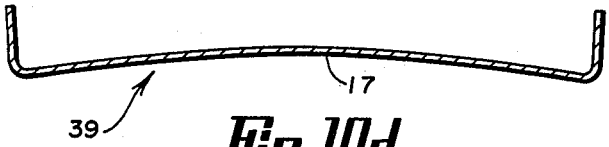
Figure 10D:
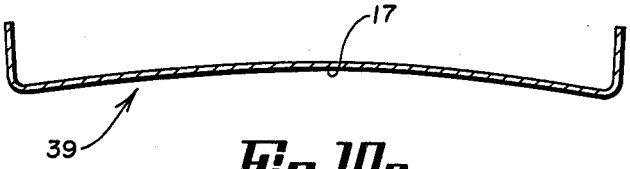
Figure 10E:
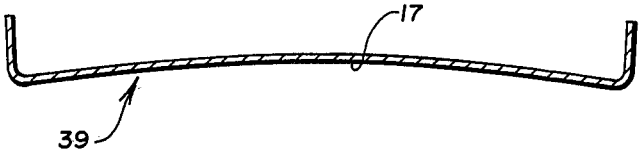
Figure 11B:
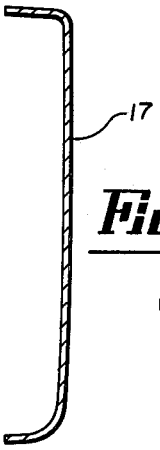
Figure 11C:
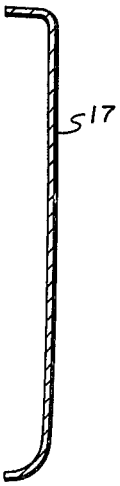
Figure 11D:
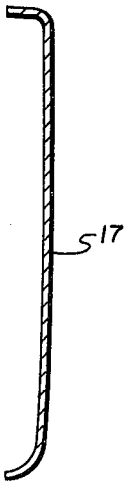

The size of the chair 12, including the height H, of the seat 15 as indicated in FIG. 6, has been designed dimensionally to fit the body sizes of ninety percent of the male and female population, those in the fifth through ninety-fifth percentile. With reference to the height H, of the chair 12, it has been found that this can be achieved with three different seat heights H. A seventeen and a half inch height H is the seat height found suitable for most adults and is the chair height that should be selected for performing adult groups and most high school organizations. A sixteen inch seat height H has been found best for most elementary and middle school students and an eighteen and a half inch seat height H should accommodate most taller performers who need a higher than average seat.

Figure 5:
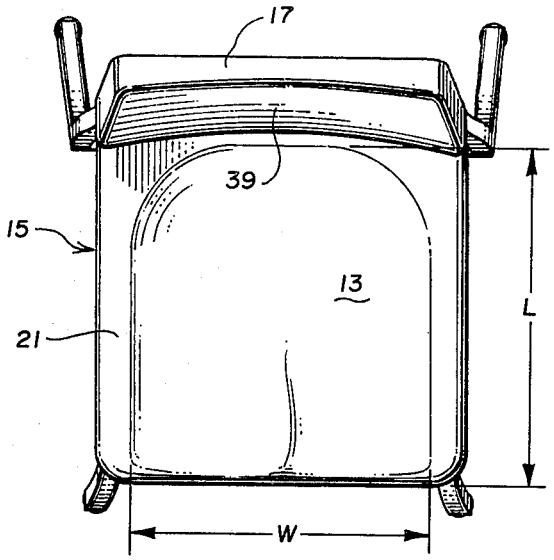
FIG. 5 is a top view of the chair shown in FIG. 4.

The width W of the contoured portion 13 of the seat 15 as indicated in FIG. 5 should also be advantageously designed to accommodate the pelvic and thigh dimensions of the fifth through ninety-fifth percentile of adult human beings.

Because the design is an integrated design of all the factors discussed above and to be discussed, each of these factors interrelates in providing the proper design for the particular performer. It has been found that the minimum seat width W of the contoured portion 13 of the chair seat 15 should be thirteen and eight tenths inches, based on measurements of the female population and the maximum width W of the contoured portion 13 of the chair seat 15 should be fifteen and eight tenths inches based on measurements of the male population.

The general positioning of the center line of the thigh on the seat 15 of the chair 12 should preferably be about four inches from the center line of the seat 15 for each thigh. The length L of the contoured portion 13 of the chair seat 15, back to front, should be approximately sixteen inches to permit full back support and to place the musician in an ideal sitting position with his feet flat on the floor.

The backrest 17 of the chair 12 of the instant invention also contributes to diaphragmatic breathing as well as comfort. The chair seat 15 to back 17 angle 30 should be more than ninety degrees in order to free the diaphragm and this, in combination with the thigh areas 22 of the seat 15 which pitch the thighs forward, accommodates foot and leg resistance when the musician is exerting muscle pressure against the diaphragm. The angular orientation 30 of the backrest 17 to the general plane of the chair seat 20 is preferably approximately one hundred degrees as shown in FIG. 6. However, the angle 30 can range between ninety-one through one hundred fifteen degrees to accomplish the objectives of the invention provided that the orientation of the general plane for the thighs 22 and the general plane for the pelvic area 24 of the seat 15 are considered when choosing the angle 30 of the backrest 17 within the range specified above.

Figure 4:
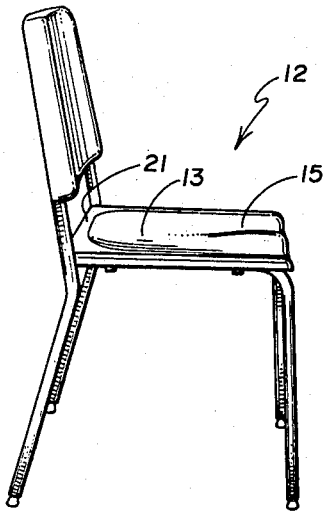
FIG. 4 is a perspective view of the chair of the present invention.

The position of the backrest 17 relative to the contour 13 of the seat 15 should also be considered and, as shown in FIGS. 3, 4 and 5, the contouring 13 at the back of the seat 15 should be generally aligned with the longitudinal centerline 33 of the backrest 17. If padding is added to the backrest 17, it 17 should be moved back a distance equivalent to the thickness of the padding when compressed.

For the chair 12 as disclosed, taking into consideration the height H of the seat 15 above the floor and the angle 30 of the backrest 17, the angular range 33 of the general plane for supporting the thighs 22 should be between three degrees above to ten degrees below the horizontal plane of the floor. Even with a gentle rise in the plane for the thigh areas 22, if the height H is chosen correctly the performer's thighs as defined by the longitudinal axis of the femur bones, will still be slanted slightly downward with the knees moving toward the floor and the feet flat on the floor which is necessary to take full advantage of the invention.

In addition to the generally downward sloping plane for the thigh area 22, as shown in FIG. 3, there also is shown a general upwardly sloping pelvic area 24. This general pelvic plane 24 built into the contour 13 of the seat 15 rotates or tilts the pelvis forward. This directs the spinal column into the flowing sacro-lumbar curve that will support the internal and external upper body in a balanced configuration.

Conventional posture chairs use bucket seats slanting to the rear with a back support contoured to match the shape of the correct sacro-lumbar dimensional range of the average adult population or to support and position the back in that curve. Although these features relieve long-term discomfort in office work tasks or at home, they restrict good diaphragmatic breathing so necessary to the musician.

Consequently the chair 12 of the instant invention does have a seat shape in the pelvic area 24 which rotates the pelvis forward to orient the spinal column for proper support of the upper body. However, no attempt is made to sculpture the chair back 17 to conform to the vertical sacro-lumbar curve. This is shown generally in FIGS. 4, 5 and 6. As shown more specifically in FIGS. 10 and 11, the vertical surface 39 of the back support 17 on the chair 12 of the instant invention is only slightly curved in a horizontal plane to conform to the natural horizontal body curve of the back. Therefore, the chair back 17 of the instant invention 12 serves as a locator or guide to good posture. It is not a full contoured back support like the office, home or spectator chair.

As shown in FIG. 3, the general plane of the pelvic area of the chair should be within the angular range 36 of three degrees below to ten degrees above the horizontal plane 20 of the chair seat 15 parallel to the floor. Again, the choice of a proper angle 36 within this range depends on the height H of the seat 15 from the floor and therefore the orientation of the legs of the performer and the angle 30 of the backrest 17 to the chair seat 15. As shown in FIG. 9, particularly **9*b*, the approximate angle shown is six degrees above horizontal. The dimensions of the general plane for the pelvic area 22 of the seat 15 should range between three inches to six inches at the back 40 of the seat 15 and should affect no more than two inches at the front 42 of the seat 15 centered on the center line of the chair. This area is shown diagrammatically in FIG. 3. Preferably there will be an angular minimum 38 of at least three degrees between the general plane for the thighs 22 and the general plane for the pelvis 24 in a chair 12** constructed in accordance with the present invention.

Finally, with the chair height H, thigh and pelvic areas 22, 24 and backrest 17 orientation 30 established the chair seat should be properly contoured to eliminate point pressures. Using the data shown in FIG. 2 the seat can be properly contoured to evenly distribute the upper body weight throughout the buttocks, hips and thighs by approximating the pressure distribution of FIG. 2 in the contour 13 of the seat 15. This produces a comfortable seat 15 as shown in detail in FIGS. 8 and 9 which eliminates the pressure points that generate pain in the area of the ischial tuberosities, under the thighs and in the area around the trochanters. (the ischial tuberosities are the sitting bones centered on each buttock and the trochanters are the outermost bone projections of the hips.) The diagram in FIG. 2 is expressed in millimeters of mercury. In pounds per square inch the figures convert to approximately two pounds per square inch in the less pressurized areas to over forty pounds per square inch under the ischial tuberosities.

The interrelationship of the various facets of the invention is demonstrated by a comparison of FIGS. 3 and 9. As shown in FIG. 3 the slope of the general plane for the thighs 22 is downward. The thighs of an average adult performer sitting on the chair 12 shown in FIG. 4, with a seat height H of seventeen and a half inches constructed in accordance with the invention, with his feet flat on the floor will slant downward as required by the invention. And even with the slight rise of the surface of the seat 15 where the thigh sits on the chair 12, on the order of three degrees as shown in FIG. **9*d***, because the plane for the pelvis has rotated the pelvis to the appropriate position, the diaphragm of the performer will still be open for proper diaphragmatic breathing.

The material of construction of the chair is preferably polypropolene which is durable yet provides a warm, soft touch. If an upholstered version is preferred, a high abrasion resistant fabric should be used and, if foam is going to be used with the chair, a high quality foam designed to hold its shape for many years of constant use should be chosen. The compacting of the foam should also be taken into consideration when choosing the planes of the seat, thigh and pelvis, 20, 22, 24, respectively, as well as the orientation 30 of the backrest 17. When the invention is constructed as described above it produces a chair 12 specifically designed for the performing musician. The diaphragm is unrestricted permitting proper breathing. Comfort of the performer is assured by the proper positioning of the spine causing the upper body muscles to relax while the formed contour 13 of the seat 15 relieves posterior discomfort.

From a consideration of the foregoing disclosure it should be obvious that the invention is a simple constructed and economically manufactured chair specifically suited to a musician's seated performance which is not susceptible to the disadvantages of prior art seating when used by a musician. It should be understood that modifications and variations may be resorted to without departing from the spirit of the invention as those skilled in the art will readily understand. Such modifications and variations are considered to be within the purview and scope of the present invention as defined by the following claims.

Having described our invention we claim:

1. A chair for a performing musician having a chair seat, a backrest and means for supporting the chair seat in a fixed position above the floor establishing a height of the chair seat, the improvement comprising:

a chair formed with a plurality of general support planes including two laterally spaced coincidental general support planes for the thighs of the performer and a central support area forming a general support plane for the pelvis of the performer; and wherein the height of the chair seat permits the musician to have both feet flat on the floor;

the general support plane for the thighs is no more than three degrees above horizontal to ten degrees below horizontal from back to front and in combination with the height of the chair seat causes the thighs of the performer to slant forward toward the floor to open the angle between the abdomen and legs of the performer to enhance diaphragmatic breathing;

the general support plane for the pelvis comprises an area lying along the longitudinal center line of the chair seat having a lateral dimension along the back of the chair seat of no more than six inches and a lateral dimension at the front edge of the chair seat of no more than two inches which is contoured to form a middle ridge along the center line of the chair seat;

the general support plane of the pelvis is inclined at least three degrees above the general support plane for the thighs of the performer from back to front to cause the pelvis of the performer to be rotated forward to relax muscle tension caused by improper support of the upper body of the performer; and wherein the backrest is positioned so that the center line of the backrest intersects the general support plane for the thighs at an angle within the range of ninety-one to one hundred twenty-five and intersects the general plane for the pelvis at the back edge of the general support plane for the pelvis so that the back of the performer is precisely positioned relative to the general plane for the pelvis in a natural and relaxed sacrolumbar curve so that the organs and upper body weight supported by the spine of the performer are in balance.

2. The improved chair of claim 1 wherein the angle between the backrest and the general support plane for the thighs is ninety-seven degrees.

3. The improved chair of claim 1 wherein the chair seat has a back edge and a front edge and wherein the slope of the general support plane for the pelvis is six degrees above horizontal from back to front.

4. The improved chair of claim 1 wherein the angle of the backrest to the general support plane for the pelvis is within the range of ninety-one degrees to one hundred eighteen degrees.

5. The improved chair of claim 1 wherein the angle between the backrest and the general support plane for the pelvis is ninety-four degrees.

6. The improved chair of claim 1 wherein the angle of the backrest to the general plane of the seat is one hundred degrees.

7. The improved chair of claim 1 wherein the chair seat has a back edge and a front edge and wherein the general support plane for the pelvis of the performer is within the range of twenty degrees to three degrees above the general support plane for the thighs of the performer from back to front.

8. The improved chair of claim 1 wherein the general support plane for the pelvis of the performer is three degrees above the general support plane for the thighs of the performer.

9. The improved chair of claim 1 wherein the height of the chair seat is within the range of sixteen and a half inches to eighteen and a half inches.

10. The improved chair of claim 1 wherein the height of the chair seat above the floor is seventeen and a half inches.

11. The improved chair of claim 1 wherein the height of the chair seat above the floor is sixteen inches.

12. The improved chair of claim 1 wherein the height of the chair seat above the floor is eighteen and a half inches.

13. The improved chair of claim 1 wherein the general support plane for the thighs and the general support plane for the pelvis of the performer are contoured to redistribute the weight of the performer throughout the buttock and thigh area.

14. The improved chair of claim 13 wherein the width of the contoured portion of the seat is within the range of thirteen and eight tenths inches to fifteen and eight tenths inches.

15. The improved chair of claim 13 wherein the seat has a longitudinal center line and wherein the contour of the seat further functions to position the thighs of the performer so that each thigh is approximately four inches from the center line of the seat.

* * * * *